US005551201A

United States Patent [19]

Anderson

[11] Patent Number: 5,551,201

[45] **Date of Patent: * Sep. 3, 1996**

[54] PVC BUILDING TRIM

[76] Inventor: Carl E. Anderson, 2589 Richmond Terr., Staten Island, N.Y. 10303

[ * ] Notice: The portion of the term of this patent subsequent to Jun. 29, 2010, has been disclaimed.

[21] Appl. No.: 805,853

[22] Filed: Dec. 10, 1991

[51] Int. Cl.[6] ..... F04F 19/02

[52] U.S. Cl. ..... 52/717.05; 52/287.1; 52/717.01; 52/718.04; 428/906

[58] Field of Search ..... 52/717.1, 211, 52/212, 287, 288, 287.1, 288.1, 717.05, 717.03, 717.01, 718.02, 741.1; 428/906, 174

[56] References Cited

U.S. PATENT DOCUMENTS

| | | | |
|---|---|---|---|
| 3,609,928 | 10/1971 | Mock | 52/211 |
| 4,663,906 | 5/1987 | Weinar | 52/211 |
| 5,037,685 | 8/1991 | Richards et al. | 428/906 |

*Primary Examiner*—Michael Safavi

*Attorney, Agent, or Firm*—Helfgott & Karas, P.C.

[57] ABSTRACT

A PVC building trim and a method of applying the trim to a surface by bending the PVC trim to conform to the contour of the surface. The PVC is a high impact exterior PVC which can be bent to form permanent creases at a job site insitu without cracking the PVC. In one embodiment the PVC is fastened to the surface and a PVC molding is attached to the PVC trim to cover any fasteners which may be used. The PVC trim can be provided in a coil.

7 Claims, 4 Drawing Sheets

PVC BUILDING TRIM

BACKGROUND OF THE INVENTION

This invention relates to building trim and a method of applying building trim, and more particularly to a PVC trim and a method of applying the trim by utilizing a PVC material which can be contoured to conform to a wall shape, can be permanently bent to cover sharp corners and which can be provided in a coil form, and cut in lengths to a desired size.

In the past, building trims have been made of various materials which have been applied by a variety of methods to the areas to be trimmed and covered. For example, wood trim is sawed into selected lengths, mitered and nailed in place. Rubber trim is often glued into place. Aluminum trim is provided in strips and can be bent insitu on a bending brake. Although vinyl trims have been used, these are always extruded into predetermined shapes and come pre-bent for various selected uses. The pre-bent and shaped vinyl trims are unwieldy to handle and are somewhat difficult to work with.

With more people doing their own repairs and decorating, trimming materials which are easily used and handled by both the skilled and unskilled workers are becoming more important. It is important that the materials be easily transportable in a car, not require complex professional tools for application and in fact, be easy to apply. In addition, the trimming materials should be durable and stable, e.g., should retain their color, shape and impact properties after prolonged indoor and outdoor exposure.

Historically, while PVC has excellent impact strength, thermoforming properties, die cutting properties, chemical resistance, color retention and impact properties, PVC has generally not been used for trim since PVC could not be bent and manipulated at a job site. PVC used for siding and to a limited extent trim has been pre-bent and shaped making it unwieldy and difficult to use. Trim made of aluminum has been used in almost all situations to finish off specific areas such as doors and windows, corner edges, moldings, etc. Aluminum sheet material utilized as trim is generally bent insitu in order to achieve the proper size and fit. A portable bending brake of the type described in U.S. Pat. No. 4,351,176 is set up at the job site and elongated strips of sheet metal are bent into the desired shape.

It has been unexpectedly found that there are certain grades of PVC material which have the typical PVC properties which make it an excellent vehicle for indoor and outdoor trim, however, they can be contoured, coiled and also bent with a bending brake at a job site insitu. In particular the PVC which is the subject of this invention is a high impact exterior PVC making it suitable for both outdoor and indoor applications. The PVC used in the present invention, unlike the PVC previously used for siding and mouldings, can be bent without cracking since it is not brittle. The PVC can be bent to form a crease which will be retained and provide a sharp edge. In addition, the PVC is sufficiently flexible so that it is coilable for easy transportability and will conform to rounded surfaces without cracking or creasing. The PVC is also trimable with a razor blade or shears making it easy to mate surfaces such as at mitered corners.

Furthermore, because of the flexible nature of this material it can be formed into a coil and marketed and transported in a coil form. In use the trim is unwound from the coil and then cut into desired lengths and the curvature of the coil will straighten out. The material can be fed out and supported in very great lengths and bent or sent through cold forming processes to form seamless vinyl siding, or gutters. These permanent bends will be retained by the material.

While various materials such as aluminum can be bent insitu and have b used for building trim with varying degrees of skill required for application, still further improvements in building trim and in methods of applying the trim would be beneficial. These improvements would be particularly beneficial if the materials are easily transportable and can be applied by both skilled people and people of ordinary skills.

SUMMARY OF INVENTION

Accordingly, it is an object of the present invention to provide a new and improved trim material and a method of utilizing the trim material.

A further object of the present invention is to provide a trim material which can be easily transported and handled.

Another object of the present invention is to provide a method of using a trim material which can be applied by both professionals and people of ordinary skill.

A still further object of the present invention is to provide a method of applying building trim utilizing PVC.

Another object of the present invention is to provide coils of PVC trim material which can be bent insitu to the proper shape and easily cut insitu to the required size.

A still further object of the present invention is to provide a PVC trim which can be bent without cracking to form permanent creases.

Briefly, in accordance with the present invention polyvinylchloride or PVC as it is more generally called, is used as a trim material. The PVC material which is the subject of the present invention is a high impact exterior PVC which is suitable for both outdoor and indoor application. The grades of PVC which are suitable can be coiled and bent to retain a permanent crease without cracking. The PVC material has excellent color, shape and impact properties even after prolonged outdoor exposure.

The PVC can be coiled and furnished in spools. The spooled material is uncoiled and is applied to the surface which is to be trimmed such as outdoors to a window casing or indoors to a baseboard. In a preferred embodiment, the trim consists of a first part which has a fastening surface running along the length of the trim. The first part is bent to the shape of the surface, typically with a bending brake and is secured to the surface by appropriate means such as screws screwed into the fastening surface or double stick tape.

The first part of the PVC material can be hand bent around curves to follow the contour of the surface and can be either hand bent in a brake to form sharp corners or other shapes requiring a sharp edge. Outside corner bulges may be trimmed with a razor blade and inside corners may be pressed sharply in place with a sharp object such as a piece of pointed wood. A characteristic of the PVC materials is that slight creases made during application can be unfolded and full creases will remain. After the trim is secured in place, a second part of the PVC trim forming a molding can be snapped into place. The second part of the trim is formed to snap onto retaining lips on the first part of the trim. As the second part of the trim is snapped into place, it will necessarily follow the contour of the first part of the trim and the person applying it will make bends, cuts, and creases as required.

In an alternate embodiment, the trim consists of a single piece of PVC which attaches to a wall without a second piece. The trim can be secured in place by double stick tape or nailed with nail heads which match the trim and are therefore unobtrusive.

The trim can be provided in a coil and unwound as needed. The slight curvature from the coil will unwind and permit the trim to return to a flat shape. The trim can then be fed out as long as desired and can be bent or cold formed into a desired shape for seamless vinyl trim or gutters, or the like.

The aforementioned objects, features and advantages of the invention, will, in part, be pointed out with particularity, and will, in part, become obvious from the following more detailed description of the invention taken, in part, with the drawings which form an integral part thereof.

BRIEF DESCRIPTION OF THE DRAWINGS

In the various figures of the drawings like reference characters designate like parts.

DETAILED DESCRIPTION OF THE PREFERRED EMBODIMENT

Figure 1:
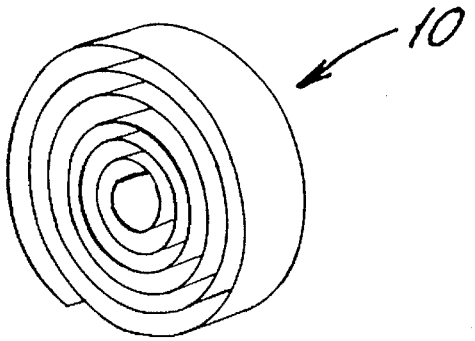
FIG. 1 is a coil of PVC trimming material.

The invention relates to a method of using polyvinylchloride, which is more commonly known as PVC, as a building trim material. PVC material has historically been viewed as a rigid material which will crack upon sufficient bending rather than crease. It has also been viewed as not being resilient upon limited bending. This has limited PVC as a trim to uses in which only pre-cut and shaped lengths are suitable. Since insitu bending was not possible, finish trim on windows, doors, walls etc. was made out of other materials such as aluminum. The PVC used in this invention is a high impact exterior PVC. The PVC is a rigid plastic film which can be slightly bent without creasing and when released will unbend. If, on the other hand, the PVC is sufficiently creased, the crease will be permanently retained and there will be no cracks along the crease line. The PVC has excellent color and impact properties even after prolonged outdoor use, and has good chemical resistance. Accordingly, the PVC is good for both outdoor and indoor use.

Typical of a PVC composition which falls within the class of PVC compositions which is suited for use as a trimming material is a PVC film made by Nan Ya Plastics Corporation, Carteret, N.J. and designated "BWSBHXX". The characteristics of the PVC are as follows:

| PROPERTY | TEST METHOD | TYPICAL VALUES |
|---|---|---|
| Thickness (mil) | | 40 ± 5% |
| Width tolerance | | +/− 1/16 |
| Color | | White |
| Gloss value (Gardner 60) | | Less than 40 |
| Gels per sq. ft. | | 7 Max |
| Carbonized particles per 100 sq. ft. | | 5 Max |
| Specific gravity | ASTM D792 | 1.40 +/− .02 |
| Tensile strength (psi) | ASTM D882 | 6900 |
| Tensile modulus (psi) | ASTM D882 | 360,000 |
| Flexural strength (psi) | ASTM D790 | 13,000 |
| Flexural modulus (psi) | ASTM D790 | 430,000 |
| Izod impact (ft-lb/in.) | ASTM D256 | 5.0 |
| Elongation % | ASTM D882 | 100 |
| Heat distortion temp. °F. | ASTM D1637 | 162 |
| Flammability | ASTM D635 | SE |
| Cold break temperature | ASTM D1790 | −4° F. |
| Resistance to greens, oils and fats | ASTM D722-45 | Excellent |
| Resistance to acids | ASTM D534 | Excellent |
| Resistance to alkalies | ASTM D534 | Excellent |
| ASTM cell classification | ASTM D1784 | 16344 |

The PVC has excellent impact strength, thermoforming properties, die cutting properties, good chemical resistance and excellent color and impact retention, even after prolonged outdoor exposure.

Other typical PVC composition which can be used for the purpose, are made by Occidental Chemical Corporation, Wayne, Pa. and are designated "OXYBLEND® 3773 PVC Compound" and "OXYBLEND® 3315 PVC White". The characteristics of the 3373 PVC are as follows:

GENERAL DESCRIPTION - Oxyblend ® 3773 is a white compound for extrusion of durable rigid PVC profiles.

| TYPICAL PROPERTIES | VALUE | ASTM |
|---|---|---|
| Specific Gravity (±.002) .125" (3.2 mm) Specimen | 1.45 | D-792 |
| Izod Impact, ft. lb./in. notch (kJ/M) | 5.0 (0.27) | D-256 |
| Tensile Yield Strength, $10^3$ psi (MPa) | 6.90 (47.5) | D-638 |
| Tensile Modulus, $10^5$ psi (GPa) | 3.60 (2.48) | D-638 |
| Flexural Yield Strength, $10^3$ psi (MPa) | 13.3 (91.6) | D-790 |
| Flexural Modulus, $10^5$ psi (GPa) °C. | 4.30 (2.96) | D-790 |
| DTUL at 264 psi (18.5 kg/cm$^2$), °F. | 72<br>162 | |
| Flammability | SE | D-635 |
| ASTM Cell Classification | 16344 | D-1784 |

The 3315 compound includes polyvinyl chloride, titanium dioxide, tin, heat stabilizer, polymer impact modifier and calcium carbonate.

The BW5BHXX compound includes a PVC, titanium dioxide, impact modifiers, stabilizers, lubricants, processing aids, pigments, a filler and UV enhibitor.

It should be appreciated that heretofore, PVC material has always been provided in sheets or strips. The pieces are usually extruded to particular shapes desired. PVC has previously not been provided in coils since it was thought that it would either crack if coiled up too much and even if it would not crack, the coil bend would remain permanent and prevent use as a trim.

Referring to FIG. 1, a roll of PVC film of the present invention is shown generally designated as 10. The PVC will be unrolled and used as a trim material. In rolled form the PVC trim is easily transportable in a car or truck and moved around a job site. When uncoiled it reverts to its elongated shape without crease.

The PVC of the present invention provides the ability of being used as a trim because of the properties that it exhibits. Firstly, slight curves can easily be made in the trim and they will not cause permanent creases. Secondly, major bends can be made in the trim and these will be formed without cracks and will be retained as permanent bends. As a result, there are multiple ways in which the PVC can be used as a building trim.

Figure 2:
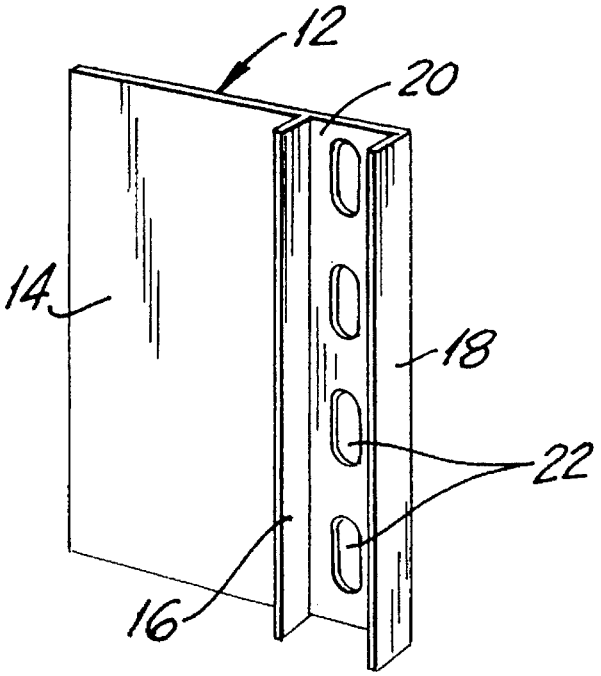
FIG. 2 is a view of a section of PVC trim with a fastening surface which attaches to a surface to be trimmed.
Figure 3:
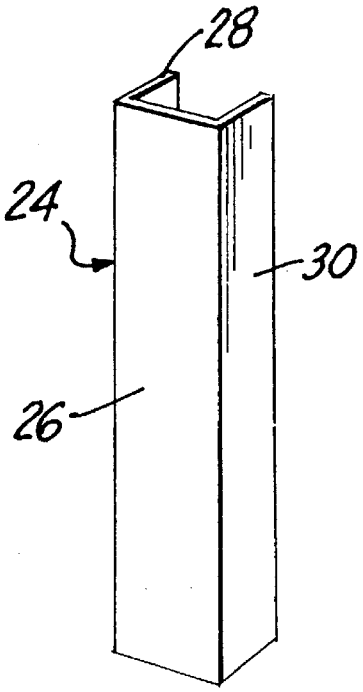
FIG. 3 is a view of a piece of molding which snaps over the fastening surface of the trim shown in FIG. 2 to cover the fastening means.

Referring to FIGS. 2 and 3, there is shown one use of the trim wherein the trim consist of two parts. A first part 12 has a flat back surface 14 and two retaining lips 16, 18 extending away from the surface 14 and running parallel to each other. Intermediate the walls 16, 18 is a fastening surface 20 through which fasteners can be applied to attach the first part 12 of the trim to a building surface as will be explained. The fastening surface has holes 22 spaced along its length through which fasteners may be inserted into the building surface. Alternately, a double stick tape can be used.

Figure 4:
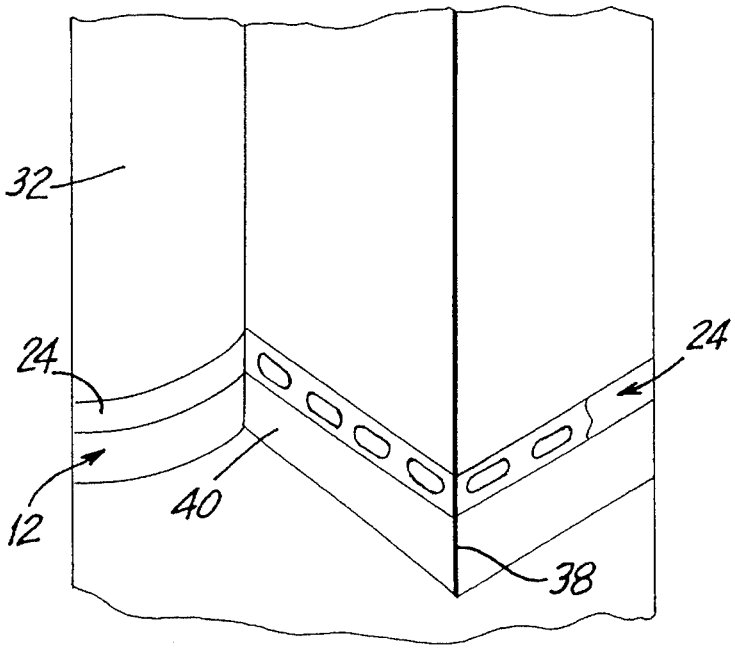
FIG. 4 shows an indoor application with a wall of varying contours being trimmed.

The second part 24 of the trim is a molding which includes a back surface 26 and two gripping walls 28, 30 extending away from the back surface and running parallel to each other. The retaining lips 16, 18 and the gripping walls 28, 30 each have a limited amount of flexibility. The distance between the gripping walls is slightly less than the distance between the retaining lips. The distance and flexibility characteristics of the walls and lips are selected so that the gripping walls can be urged or snapped onto the retaining lips to form a cover over the fastening surface. Matching hooks could be provided at the distal edges of the walls and lips to provide or secure engagement Referring to FIG. 4, a typical indoor use of the PVC trim of FIGS. 2 and 3 will be described for placement along a wall adjacent a floor. In order to use the PVC trim the first part 12 is applied to a surface such as a wall either directly from a coil or an approximate length of trim is cut from the coil with a shears or a blade.

The trim 12 is placed along the base of the wall 32 adjacent to floor 34. The PVC trim 32 will bend without cracking and therefore can be hand bent around curves such as at 36 to conform to the wall contour. At the same time, the PVC material will assume a permanent sharp bend if it is sufficiently bent back upon itself. The outside corner 38 is formed by hand bending the trim around the corner and then bending the trim back upon itself to make a permanent sharp corner.

As the trim is placed along the wall the trim is secured to the wall by using appropriate fasteners such as nails or screws which are inserted through the fastening surface 20 into the wall 32. When the first part 12 of the trim is in place, the second part 24, which is the molding, is urged over the retaining walls 16, 18 to cover the fastening surface. The second part 24 is easily hand bent around the curved part of the wall 36 and is retained on the first part 12. The outside corner 38 of the cover trim 24 is hand bent to form a permanent crease. When the trim 24 is placed on the corner 38, there will be bulges which may easily be trimmed with a single edge razor blade. It should be appreciated that double stick tape could be used in place of the screw fasteners or nails.

Inside corners, such as 40, are also hand bent to form a sharp edge. In addition, inside corners may be pressed sharply in place with a pointed object such as a piece of wood. Any bulges may be trimmed with a razor blade.

Wires and carpeting edges can be concealed by simply positioning the bottom of the molding 12 away from a wall to create a hollow. This position necessitates angle cuts at corners.

Figure 5:
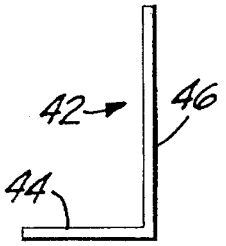
FIG. 5 is an alternate embodiment of the trim.

FIG. 5 depicts an alternate embodiment of the PVC trim of the present invention in which an "L" shaped piece of trim 42 has a bottom part 44 which can go under a rug or lie on a floor and a vertical part 46 which goes against a wall. The trim can either be provided as a coil of "L" shaped, pre-bent PVC or as a coil of flat PVC strip which can be permanently creased in a portable bending brake insitu. The trim is installed as is the trim described above. The trim may be glued or taped in place or secured with fasteners with heads which match the color of the trim, e.g. nails which go through part 46 into the wall. It should also be appreciated that nails will go through the vinyl material without causing cracking or splintering of the vinyl material.

Figure 6:
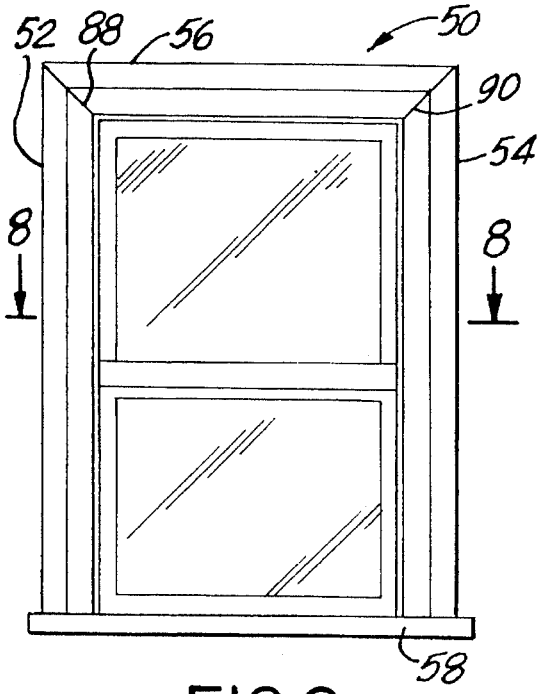
FIG. 6 is an outdoor application with a window being trimmed.

Next will be described a typical outdoor finish trimming of a window using the vinyl of the present invention. The technique and use of the PVC is equally applicable to other outdoor uses such as doors and corner edges. In FIG. 6, a window 50 is shown which is trimmed in accordance with the present invention. The trim as shown comprises two parallel side panels 52, 54 interfit with an upper panel 56 and a windowsill covering 58. It should be understood that in case no ledge or windowsill is provided the upper trim panel may be utilized to also trim the lower edge of the windows.

Figure 7:
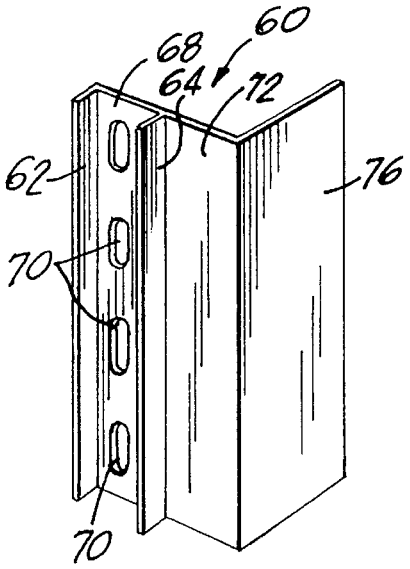
FIG. 7 is a view of a section of trim having been bent for attachment to a window casing.
Figure 8:
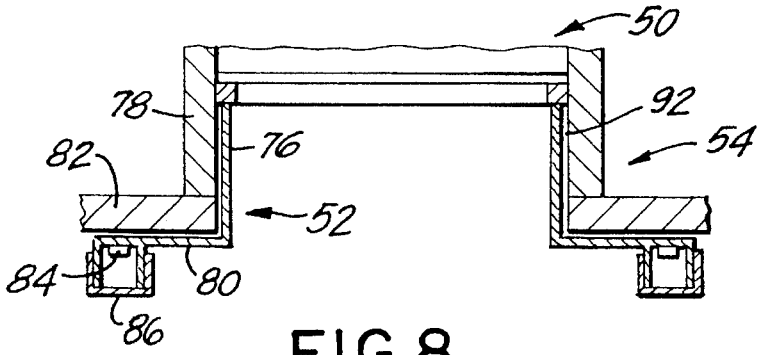
FIG. 8 is a sectioned view of the window in FIG. 6 showing the trim as applied to the casing.

As can be seen in FIGS. 7 and 8, the trim that is being utilized is similar to the trim shown in FIG. 2. Specifically, a first part 60 of the trim is similar to first part 12 of FIG. 2. Part 60 only differs from part 12 in its dimensions, e.g. the overall width of the PVC trim. Part 60 has retaining lips 62, 64 and a fastening surface 68 with holes 70 for receiving fasteners.

The first part 60 can be provided in a coil with the back surface 72 flat. The trim is uncoiled and cut to a length desired with a shear, razor blade or utility knife. The first part is then bent along its length either over a straight edge or preferable by a portable bending brake to form a permanent right single crease 74. The bent side 76 is sized to fit over the inside 78 of a window casing and the unbent part 80 covers the front 82 of the window casing. Fasteners 84 secure the first part of the trim to the front 82 of the casing. A cover 86 which is similar to the second part or molding 24 of the trim shown in FIG. 3, except for its dimensions, is then inserted over the retaining lips 62, 64 to cover the fasteners.

The side panel 54 is formed in a similar fashion to side panel 52 except that the first part of the trim 60 is turned over. The upper panel 56 is also formed in a similar fashion to side panel 52 except for its orientation. The windowsill covering 58 merely requires additional bends and trimming. A flat piece of PVC such as was described in FIG. 5 without retaining walls may be used by directly fastening the PVC to the casing, e.g. by nailing through the PVC into the trim. Double stick tape can also be sued as shown at 92.

As shown in FIG. 6, mating surfaces at corners 88, 90 may be made very accurately by slightly overlapping the side panels and the upper panel and trimming with a razor blade. Since the PVC of the present invention can be bent and creased like aluminum, it can be substituted for the usual aluminum finish trimming thereby providing an all PVC house covering. Aluminum coil has never been capable of matching vinyl windows and vinyl siding which is typically used. By permitting for the use of vinyl trim in accordance with the present invention, a perfect match can be achieved between the siding, windows and trim. This has the advantage of simplifying a job since all materials can be of the same type.

The particular trim shown in FIGS. 2 and 3 and in FIGS. 7 and 8 provides for a finished look with an edge moulding. At the same time it makes use of the unique properties of the pressed vinyl material since it permits bends and contours. Even more efficient use can be made of the vinyl material of the present invention and yet provides for the same finished look by using three parts to the trim as shown in FIGS. 9 and 10.

Figure 9:
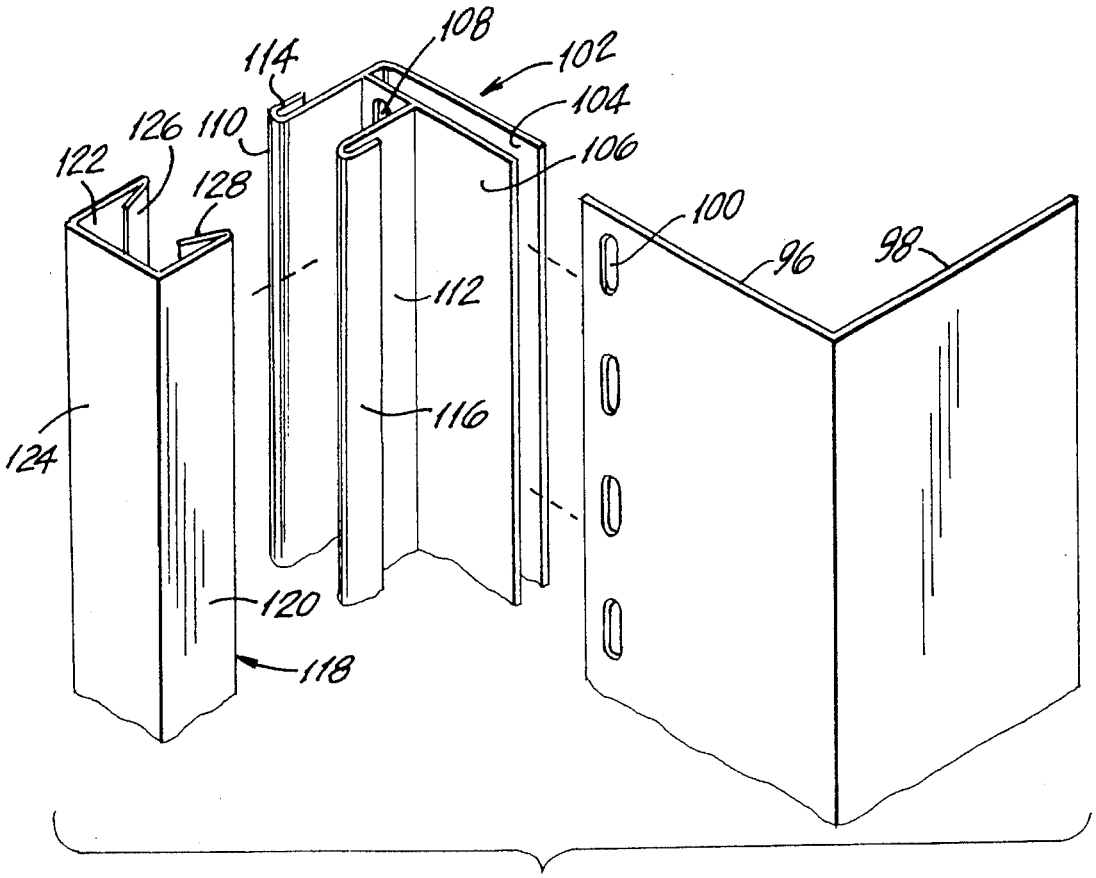
FIG. 9 is an exploded perspective view of another embodiment of the invention.
Figure 10:
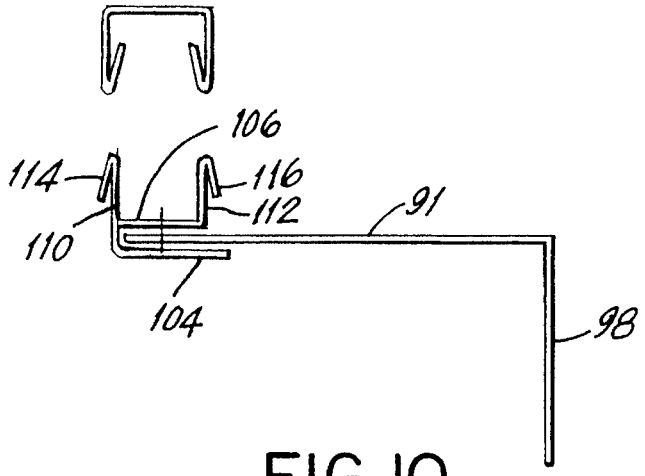
FIG. 10 is a schematic top view of the assembled pieces of FIG. 9.

As is shown in FIGS. 9 and 10, the vinyl trim of the present invention can be formed of three pieces. The main piece 94 is an "L" shaped piece having opposing legs 96 and 98. This piece can be provided as a flat strip on a coil as shown in FIG. 1 and bent insitu to the desired width of the opposing legs. The elongated slots 100 can be pre-formed in leg 96 and can receive fasteners. The second part of the trim would be extruded forms a slide on portion 102 which comprises the two "V" shaped legs 104, 106 which slide over the edge of the leg 96 of the first part. Elongated slots 108 can be formed in both the legs 104 and 106 to mate with the slots 100 for receiving the fasteners. Parallel receiving lips 110, 112 project from the wall 106 and include hooks 114, 116 at their distal edges. The third piece 118 is the molding in the shape of a "U" shaped channel having opposing parallel walls 120 and 122 spaced by a connecting wall 124. Mating hooks 126, 128 at the distal edges of walls 120 and 122 engage with the hooks 114, 116.

By utilizing the embodiment of FIGS. 9 and 10 flat strips for the piece 94 can be provided from the coil. The strips are bent insitu to form the first part 94 and then the second part 102 being pre-molded can be cut as needed and slid on. The molding 118 can then be snapped on in place.

Figure 11:
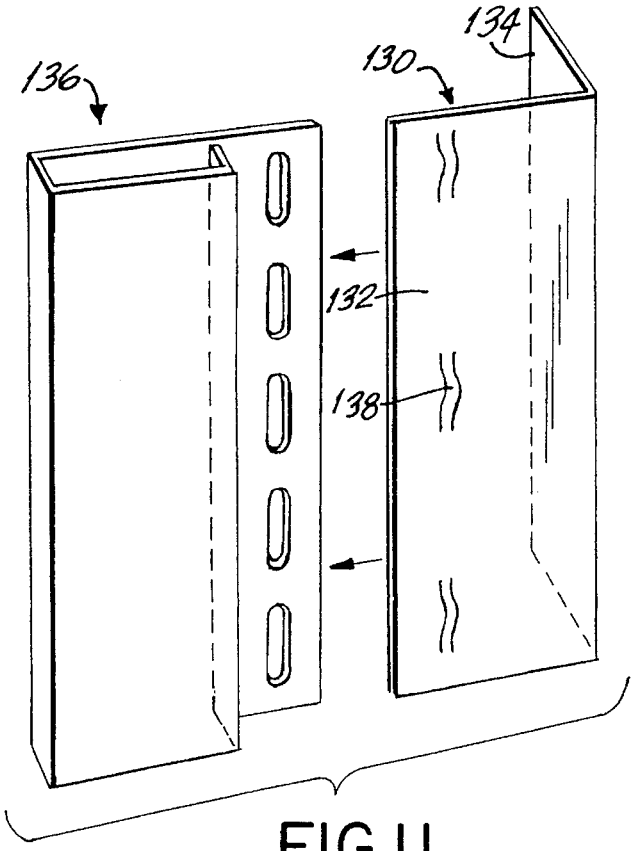
FIG. 11 is an exploded prospective view of another embodiment of the invention.

FIG. 11 shows another application of the vinyl trim of the present invention. In this case, the vinyl trim can be provided in a flat strip on the coil as shown in FIG. 1. The strip can be unwound to form the first part 130. This strip is then bent into a first portion 132 and a second portion 134 in order to wrap around a window or door. This portion can then slide into an extruded vinyl section 136, which is known as an omni-receiver. Such part is commonly sold under the name Undersill. The omni-receiver is used to provide an edging on vinyl trim which may not terminate at equal lengths. The omni-receiver is a usual cover over the uneven edges to hide such unevenness and provide a uniform molding. In the present case, the omni-receiver can be used to receive the bent trim of the present invention to provide an edge molding.

In order to lock the trim into the omni-receiver, protrusions 138 can be formed along the side 132. Such protrusions can typically be formed by a snap-lock punch using a tool sold by Malco which creates such protrusions in the materials. The bent vinyl trim 130 can then be locked into the omni-receiver.

It should, therefore, be appreciated, that the vinyl material of the present invention can be used in numerous configurations to form the vinyl trim. As previously recited, heretofore it was unknown that vinyl material could be used for vinyl trim in the manner presently provided. It was the thought that the particular type of vinyl materials heretofore described do not have the ability of resiliency to slight creases nor permanence to heavy creases. Specifically, it has been found that these features permit the vinyl to be provided in a coil and such coil to be unwound without any permanent creases, thereby permitting the vinyl trim to be transported in coil form. Likewise, the ability to retain permanent creases permits the vinyl strips to be unwound from the coil and permanently bent to provide window and door trim. Such permanent creases are formed without cracks.

Because of the unique characteristics of the vinyl, the vinyl can also be used to form seamless vinyl siding and other building trim materials. As has heretofore been explained, typically, vinyl has always been provided in extruded form with pre-bent shapes and, thus it was provided in enlongated strips. As a result, such strips were typically of finite length, such as 12' lengths. As a result, in providing any type of vinyl, such as vinyl siding or vinyl trim, the pieces had to be transported and stored in their full length. Furthermore, they had to be pieced together where the length of the surface to be covered was greater than 12'.

Even where aluminum was used for siding, although aluminum could be provided in a coil, it was not possible to provide seamless aluminum trim. The reason is that when bending aluminum trim on a brake, the aluminum would scratch and would dent very easily. Accordingly, it was only possible to bend finite lengths of aluminum and it was required to cut the aluminum into workable lengths and apply it to the house.

Accordingly, heretofore it was not possible to provide for seamless vinyl trim or seamless gutters and the like, neither in vinyl nor in aluminum. However, utilizing the heretofore vinyl of the present invention, it is possible to provide for seamless vinyl trim, gutters, and the like.

Specifically, the vinyl material of the present invention can be provided in a coil as shown in FIG. 1. The vinyl strip is then unwound from the coil and fed into the bending brake. The bending brake may typically only bend finite lengths such as 6' or 8'. The vinyl is not cut from the coil but is fed into the bending brake directly from the coil. In fact, the bending brake can include a shaft on which the coil can be placed to feed out the vinyl strip from the coil.

The finite length of material is fed into the bending brake and the vinyl is then bent. The bent portion is then slid out from the bending brake and pulled forward. It can be supported on struts, horses, or any other support. The next section of vinyl to be bent is then unwound from the coil and fed into the bending brake. This is likewise bent and after bending is moved forward along the supports. This process can be continued to provide any lengths desired. Accordingly, particular bends can be formed as is required for vinyl siding and the full length of the surface to be covered can be done without any seams.

Instead of feeding the vinyl trim into the bending brake, it can be fed into any other cold forming process. Likewise, it can be roll formed directly from the coil. In this manner, through the use of either the bending brake, cold forming or roll forming, numerous building trims can be formed. These can all be one piece and seamless and can include vinyl trim, vinyl siding, fascia, friezeboard, or even seamless gutters.

Figure 12:
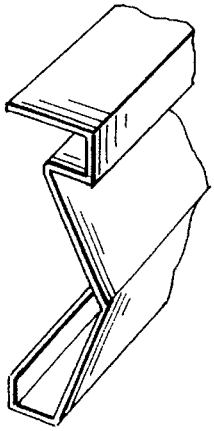
FIG. 12 is a prospective view of a commercial fascia utilizing the PVC of the present invention.
Figure 13:
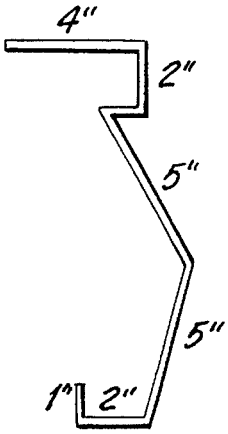
FIG. 13 is and end view of the fascia shown in FIG. 12.

Additionally, because the vinyl material is so forgiving, does not scratch easily, will resist slight creases and is resilient, complex shapes can be formed in the vinyl trim as it is fed out from the coil. By way of example, reference is made to the complex configuration shown in FIGS. 12 and 13 which show a commercial fascia on which there is shown approximate sizes in inches of each of the sections. The particular shape shown would be difficult to bend in aluminum trim. Heretofore, if made in vinyl trim it would have to extruded and would come in finite lengths. Because the vinyl in the present invention is forgiving, easily bent without cracking, and can be provided on the strip, these bends can be formed insitu and can be formed of any desired length in order to make one piece, seamless fascia.

There has been described a preferred and alternate embodiments of the invention. However, it should be understood that various changes and modifications may be made thereto without departing from the spirit and scope of the invention.

What is claimed is:

1. A PVC building trim, comprising:

a coil of high impact exterior PVC strip material for use as an in-situ bendable building trim, said PVC strip material having the characteristic of restoring its flat shape upon being unwound from the coil without cracking or creasing, being able to restore its shape after slight contouring, and being cold bendable to form a permanent crease without cracking.

2. A PVC trim according to claim 1, wherein the PVC strip material has a fastening surface for securing the strip to a surface to be trimmed.

3. A PVC trim according to claim 1, wherein the PVC strip material is not permanently deformed or creased by being in the coil.

4. A PVC trim according to claim 1, wherein said PVC strip material is formed of a composition of polyvinyl chloride, titanium dioxide, heat stabilizer and impact modifier.

5. A PVC trim according to claims 1 wherein said PVC is selected from the group consisting of BWSBHXY, OXYBLEND 3773 PVC compound and OXYBLEND 3315 PVC white.

6. A PVC trim according to claim 1, wherein said PVC strip material is a substantially flat material provided in a coil, said trim comprising a slidable edging vinyl part for sliding onto one distal side edge of the strip material, said edging vinyl part comprising a pair of spaced apart rear walls forming a receiving pocket therein and two retaining lips extending from one of the rear walls substantially perpendicular thereto, said retaining lips running substantially parallel to one another, and a snap-on molding vinyl part having a back surface and two gripping walls extending from the back surface and spaced from one another so as to grip the retaining lips when placed over the retaining walls.

7. A PVC trim according to claim 6 and further comprising means for securing the edging vinyl part to the strip material.

* * * * *